US008571232B2

(12) United States Patent
Goldfarb

(10) Patent No.: US 8,571,232 B2
(45) Date of Patent: Oct. 29, 2013

(54) APPARATUS AND METHOD FOR A COMPLETE AUDIO SIGNAL

(76) Inventor: Barry Stephen Goldfarb, Deland, FL (US)

( * ) Notice: Subject to any disclaimer, the term of this patent is extended or adjusted under 35 U.S.C. 154(b) by 366 days.

(21) Appl. No.: 12/983,796

(22) Filed: Jan. 3, 2011

(65) Prior Publication Data

US 2011/0158413 A1 Jun. 30, 2011

Related U.S. Application Data

(63) Continuation-in-part of application No. 12/585,411, filed on Sep. 11, 2009, now Pat. No. 8,259,960.

(51) Int. Cl.
*H04R 1/40* (2006.01)

(52) U.S. Cl.
USPC ..... 381/97; 381/119; 381/89

(58) Field of Classification Search
USPC ..... 381/1, 97, 89, 119, 63, 61, 17, 18, 310, 381/309, 120, 26, 107, 303, 307, 19–23
See application file for complete search history.

(56) References Cited

U.S. PATENT DOCUMENTS

| | | | | |
|---|---|---|---|---|
| 3,725,586 | A | 4/1973 | Iida | |
| 4,218,585 | A | 8/1980 | Carver | |
| 4,815,133 | A | 3/1989 | Hibino | |
| 4,866,774 | A | 9/1989 | Klayman, II | |
| 5,692,050 | A | 11/1997 | Hawks | |
| 5,761,313 | A | 6/1998 | Schott | |
| 6,477,255 | B1 | 11/2002 | Yoshida | |
| 6,587,565 | B1 | 7/2003 | Choi | |
| 6,711,265 | B1 | 3/2004 | Morris | |
| 6,947,564 | B1 | 9/2005 | Hoover | |
| 7,003,119 | B1 | 2/2006 | Arthur | |
| 7,203,320 | B2 | 4/2007 | Coats | |
| 7,539,319 | B2 * | 5/2009 | Dickins et al. | 381/310 |
| 2005/0036645 | A1 | 2/2005 | Carver | |
| 2005/0129248 | A1 * | 6/2005 | Kraemer et al. | 381/11 |
| 2008/0101631 | A1 | 5/2008 | Jung et al. | |
| 2010/0054482 | A1 * | 3/2010 | Johnston | 381/17 |
| 2012/0121092 | A1 * | 5/2012 | Starobin | 381/17 |

FOREIGN PATENT DOCUMENTS

| | | |
|---|---|---|
| AU | 708727 | 8/1999 |

* cited by examiner

*Primary Examiner* — Vivian Chin
*Assistant Examiner* — Friedrich W Fahnert
(74) *Attorney, Agent, or Firm* — McKenna Long & Aldridge LLP

(57) ABSTRACT

The present invention relates to an apparatus and method for redeeming otherwise closed and concealed information contained in audio signals. An active circuit balances the ratio between in-phase and out-of-phase signals through the application of sum and difference signals and adjusts the ratio of gain in stereophonic signals as well as in monophonic and multichannel signal applications. This includes both the primary reference signal, and a plurality of redundant duplicate signals, substantially identical in all respects to the primary reference signal except in relation to magnitude and phase, for the purpose of unfolding, or opening the audio signal content. A pair of output signal levels approximates the golden ratio where the golden ratio is one plus the square root of five divided by two which gives an irrational number 1.618.

10 Claims, 5 Drawing Sheets

APPARATUS AND METHOD FOR A COMPLETE AUDIO SIGNAL

This application is a continuation-in-part of application Ser. No. 12/585,411 filed Sep. 11, 2009, which is hereby incorporated by reference in its entirety as if fully set forth herein.

BACKGROUND OF THE INVENTION

The present invention relates to a method and apparatus for establishing a substantially complete audio signal and especially to a method and apparatus for redeeming information from a discrete audio signal to reconstruct, or produce, a substantially whole, virtually omni-directional sound event.

Sound exists as pressure and velocity in a medium such as air. Sound begins with a mechanical disturbance, such as a voice, slamming door, bow across a violin string, and the like. The vibration of the sound source causes the formation or pattern of waves. The waves radiate in every direction, e.g., three dimensionally, omni-directionally, spherically. It is these moving waves that are heard as sound.

There are three commonly measured components of any sound pressure: frequency, amplitude, and phase, when a reference is available.

Since the birth of electronic audio signals the goal has been to capture, store, and reproduce an exact replica of the original sound event in such a way that the listener cannot tell the difference between the reproduction and the original.

An electronic audio signal is a fluctuating electric quantity whose variations represent all sound information as a code. We've learned how to unwrap much of the frequency and amplitude information portions from the signal code with a high amount of fidelity, enabling the wide bandwidth and broad dynamic range enjoyed today. Phase is one major component of sound that includes representing essentially all of the coupling of the spatial and temporal information elements of sound that has not been reproduced by conventional means with significant fidelity. As a consequence, conventionally reproduced audio signals to this point have been incomplete.

An ideal complete audio signal would be one in which all sound components are fully opened, transmitted, and reproduced with equal fidelity, including frequency, amplitude and phase. Such a signal would also be indistinguishable from the original sound event; e.g., radiate in all directions, three dimensionally, omni-directionally, spherically, rather than as existing incomplete signals do.

Because existing, incomplete audio signals can provide high fidelity duplication for only some components (frequency and amplitude) of sound, sound reproduction has heretofore been limited to a two dimensional perspective. Prior art methods, such as stereophonic, binaural, and various surround sound techniques, and beyond, offer signal processing enhancement methods and apparatus that are designed to compensate artificially for otherwise naturally occurring spatial and temporal information. These limitations leave the original sound event content elements locked away within the signal code: lost, hidden, buried, closed off, folded under, but nevertheless still contained inside the signal. The present invention is a method and apparatus for producing a substantially complete audio signal, not through the introduction of artificial elements, but by opening, or unfolding, the information that, until now, has been hidden within the audio signal.

There are multiple uses of the word "phase." General use of the term phase in audio has been limited for the most part to either the idea of proper 'phasing' of speakers, or the term 'absolute phase' to describe a maker's product. Other aspects of phase that are important are monaural phase, where, typically, delayed sounds are applied to one or both ears simultaneously. Prior art shows extensive work in the area of binaural phase, which refers to a time delay due to the difference in the path length from one ear to another. But the idea of phase as a defining characteristic of sound is not generally discussed. Nor are measurements generally provided. Phase herein is concerned with the rules of hearing as a constructive process. That is, the brain takes data coming to it from the ear, and applies rules and functions to build a representation of the sound. These rules involve complicated mechanical, biological, and neurological processes that are unbelievably subtle and complex.

Phase, as it applies to the present invention, enables sound to be rendered through a signal to the ear, in a way which is substantially indistinguishable from the original acoustic event, radiating sound in a way that is similar and like that of the original captured, transmitted, or recorded sound. Transmission of the received sound waves from the ear to the brain completes the hearing process. It is believed that phase is the 'missing link' in the ability to recreate the listening experience with substantial accuracy. The present invention uses phase to provide a listener with a listening experience that is heard as being substantially indistinguishable from the original event.

Phase is also a relative measure of one signal against a reference signal. In acoustic events, relative phase is influenced by both time and space. This is important since in a normal listening experience, whether a single (or mono) signal is recorded, or multiple signals, such as stereo, are recorded, the recorded signals represent the phase relative to information about the recorded signals at the location of the microphone. When multiple microphones are used, the phase relative information for each recorded signal is unique to the position of the microphone relative to the source as well as the acoustics of the space in which the recording takes place. Thus, one can use multiple microphones to create a monophonic signal, by summing their outputs together, or one can record discrete signals for stereophonic or surround sound applications. In general, the path of a signal from the recording through the chosen electronics and ultimately the listening environment will be uniquely different for each signal. While a significant effort has been extended to enhance the recorded signals for listening environments, inclusive of head-related transfer functions and digital signal processing to create artificial reverberation for the illusion of a different space, it is virtually impossible to separate the listener from the acoustics of the space in which the sound is heard. However, since one can accomplish gradual cross-overs in physical space by placing multiple speakers in the room, the same way in which one can record signals with multiple microphones, it is also possible to use the original signal to extract the information contained in the recording process and introduce graduated cross-overs in the recorded signal and layer these signals together, much the way that they would be layered in the physical space, to convey a more realistic, dynamic signal.

For the purpose of describing the present invention, various terms, including phase layering, phase layered circuit, or PLC, as well as terms such as graduated crossovers are employed herein.

If any sound component is distorted from its original form, all sound components may be affected. Therefore, what affects phase, amplitude or frequency, may affect all.

Stereophonic sound is an "effect" and does not exist in nature. The stereo effect produces a 'phantom image' that appears as if sound is coming from somewhere in the center between two stereo speakers, when in fact, nothing is there. It is an "illusion." The basis for defining the quality in a stereo system is how well the phantom image is able to produce a realistic "soundstage." The soundstage takes place in what is commonly called the "sweet spot." That is where the soundstage generated by the stereo system produces such a convincing phantom image that the listener experiences a "you are there" virtual reality. The soundstage breaks apart when the listener moves outside of the sweet spot, either too far to the left, or right, away from where the phantom image is taking place. Once outside the sweet spot, the illusion is gone. Most consumer based audio equipment in use today is based on a stereophonic sound standard.

There are several kinds of signal processors used in audio electronics. One type is designed to solve problems associated with the environment, such as a graphic equalizer, and is designed to tune a room to a flat frequency response, so that when an audio system plays, the room is not adding or subtracting from the sound. Another kind of signal processor adjusts the signal, such as a reverb system, and is designed to make fabricated recordings made in a studio sound as if they were recorded live. Audio engineers use these and other tools in their profession.

Another type of signal processor utilizes psychoacoustic techniques, based upon the study of how the brain interprets information coming to it from the ear. Many of these types of psychoacoustic signal processors have been used to help solve certain problems relative to stereophonic sound primarily, and can sometimes also be used in monophonic and discrete signal applications as well, but often as a secondary advantage.

Stereophonic sound has limitations such as the sweet spot area in which the phantom image is contained. Unlike live sound in which a large audience can share at one time, such as one might enjoy at a concert, stereophonic sound has a limited area between two speakers where the audience must gather in order to experience the phantom sound stage. This shortcoming in stereo sound has lead to various developments designed to overcome the limitations of soundstage size and either find ways to expand the sweet spot, or, as in the case of motion picture theater sound, which is the basis for home theater and surround sound, eliminate the sweet spot altogether with a different technology. Hence, one of the motivators for developing certain kinds of signal processors has been to enhance the stereophonic experience. The present invention is not limited to the sweet spot, and can be experienced in any venue, at any time, and under any listening conditions. Moreover, it works with all audio signals and signal paths—monaural, stereo, synthesized multi-channel, and discreet multichannel, recorded and reproduced sound and transmitted sound—as all contain information which has remained hidden and buried until the present invention.

One of the rules of high fidelity is to stay faithful to the original sound event which means, "to hear the signal without alteration." Hence, an aim for design for serious music listening, is to maintain as much signal integrity along the audio path as the state of the art allows. Hence, good audio is actually good science and there is no reason why good audio cannot and should not be applied to all audio signals. Every time an audio signal passes through any acoustical, mechanical, or electrical device distortion is created. Audio designers work to limit the amount of distortion, to maintain faithful reproduction or fidelity so that the least compromised signal becomes the highest fidelity. The substantially complete audio signal of the present invention is designed to convey significantly more of the information of the original sound event than the prior art without significantly adding anything that is not already in the signal or subtracting anything from it.

The following U.S. patents show techniques used to enhance audio sound fields primarily in stereophonic applications. There are three approaches commonly used in the past, including the application of head related transfer functions (HRTF), the use of digital signal processing to create reverberant or spatial effects to emulate a sound field other than that of the listening environment, and the use of stereophonic signals to add spatial effects. The present invention differentiates from the prior art by the method used, which can be applied to monophonic, stereophonic, or other multisignal formats. It is not dependent upon the use of stereo signals and can improve speech intelligibility and many other aspects of all signal formats.

U.S. Pat. No. 7,203,320 to Coats, et al., teaches a subharmonic generator and stereo expansion processor. A method and apparatus may provide for one or more of: receiving an input signal containing frequencies from among a first range; filtering the input signal to produce a first intermediate signal containing frequencies from among a second range; producing a sub-harmonic signal from the first intermediate signal containing frequencies from among a third range, the third range of frequencies being about one octave below the second range of frequencies; canceling energy at least some frequencies from among a fourth range of frequencies from a left channel signal of the input signal to produce at least a portion of a left channel output signal; and canceling energy at some frequencies from among a fifth range of frequencies from a right channel signal of the input signal to produce at least a portion of a right channel output signal.

U.S. Pat. No. 7,003,119 to Arthur is for a matrix surround decoder/virtualizer which uses several sub-systems to generate outputs from the stereo input signal. A first sub-system synthesizes the phantom center output, which places the monaural center image between the left and right speakers in front of the listener. A second sub-system synthesizes the virtual surround (or rear) output signals, which places the sound images to the sides of the listener. A third sub-system synthesizes the left and right stereo outputs, and expands the locations of the left and right sound images.

A stereophonic spatial expansion circuit with tonal compensation and active matrixing is shown in Hoover, U.S. Pat. No. 6,947,564. In a stereophonic expansion circuit, the (L+R) sum signal is spectrally modified by increasing the bass and treble frequencies relative to the midrange so as to compensate for a midrange frequency boost in the (L−R) difference signal. The stereophonic expansion effect and manipulation of the signal parameters are produced by active matrixing amplifiers.

U.S. Pat. No. 6,711,265 to Morris is for a centralizing of a spatially expanded stereophonic audio image. A stereophonic system has sum and difference signals with expanded spatial imaging. Localization of center audio materials more towards the center is accomplished by equalization of the (L+R) sum signal. The equalization comprises decreasing the bass response while increasing the treble response of the sum signal with the desired bass reduction being accomplished by the use of a gyrator to economically synthesize an inductance. Additionally, the equalizations in the (L+R) sum signal to reduce the signal at bass frequencies and to increase the signal at treble frequencies are switchable singly or in combination between ON and "OFF" modes.

In U.S. Pat. No. 6,587,565 to Chol, a system is provided for improving a spatial effect of stereo sound or encoded sound when producing three dimensional image sound signals from signals of stereo channel. This includes a spatial effect enhancing portion where a signal for enhancing spatial effect and directivity of sound is produced, a band enhancing portion where a signal for enhancing a signal component of the stereo channel signal in a low frequency range and for maintaining the signal component in a middle frequency range is generated, and a matrix portion where the output signal of the spatial effect enhancing portion, the output signal of the band enhancing portion and the stereo channel signal are calculated in a matrix manner, so that the spatial effect of sound is improved using a differential component between left and right side channel signals. According to the patent, the spatial effect of sound can be improved without using a complicated circuit construction, the deterioration of Signal to Noise ratio is prevented, and the cost-performance ratio for realizing a spatial effect of sound is improved.

U.S. Pat. No. 6,448,846 to Schwartz is for a controlled phase-canceling circuit and system. The patent describes controlling the phase relationship between a processor's output or portions of a processor's output and the phase of the preprocessed signal in a particular frequency range or ranges, so that a controlled accentuation or enhancement of the processor's effect can be realized. In one embodiment this is achieved by providing a gain control circuit that receives and selectively amplifies the input signal prior to it being summed with the processor's output.

Australian Patent No. 708,727 to Klayman teaches a stereo enhancement system.

U.S. Pat. No. 5,761,313 to Schott is for a circuit for improving the stereo image separation of a stereo signal. By using special frequency response manipulation in the difference channel of a stereo signal, the stereo image will appear to extend beyond the actual placement of the loudspeakers. This is accomplished by shaping the difference channel response to simulate the response one would be subjected to if the sources were physically moved to the virtual positions. The circuit includes a summing and high frequency equalization circuit to which the left and right stereo signals are applied, and a difference forming and human ear equalization circuit also to which the left and right stereo signals are applied. The outputs from these circuits are cross-coupled to form left and right channel outputs.

U.S. Pat. No. 5,692,050 to Hawks is for a method and apparatus for spatially enhancing stereo and monophonic signals. A method and apparatus is disclosed that spatially enhances stereo signals without sacrificing compatibility with monophonic receivers. In accordance with one embodiment, a stereo enhancement system is implemented using only two op-amps and two capacitors and may be switched between a spatial enhancement mode and a bypass mode. In other embodiments, simplified stereo enhancement systems are realized by constructing one of the output channels as the sum of the other output channel and the input channels. In other embodiments, a pseudo-stereo signal is synthesized and spatially enhanced according to stereo speaker crosstalk cancellation principles. In yet other embodiments, the respective spatial enhancements of monophonic signals and stereo signals are integrally combined into a single system capable of blending, in a continuous manner, the enhancement effects of both.

U.S. Pat. No. 4,959,859 to Kennedy et al. is for an FM channel separation adjustment system.

The conventional definition of an anti-phase signal is one that has inverted phase (180 degrees) as summarized in U.S. Pat. No. 6,477,255.

U.S. Pat. No. 4,866,774 to Klayman is a stereo enhancement and directivity servo. In a stereo system having sum and difference signals that are processed for stereo image enhancement, apparent directivity of the stereo sound is increased by the use of servo systems for the left and right processed difference signals (L−R)p, (R−L)p. Each of the left and right servos responds to the respective left or right stereo input signal (L−in, R−in) and amplifies increases in the respective left or right processed difference signals. The amount of amplification is controlled by feeding back the amplified or directivity enhanced difference signal (L−R)pe, (R−L)pe, first comparing it with the processed difference signal (L−R)p, (R−L)p before directivity enhancement, and then combining it with the input signal (Lin, Rin) in a preselected ratio so as to control the amount of amplification of the processed difference signal that is provided for directivity enhancement.

U.S. Pat. No. 4,815,133 to Hibino teaches a sound field producing apparatus connected to a stereophonic sound source to supply audio signals to a loudspeaker system that has an indirect sound extracting circuit for extracting indirect sound components by extracting a difference signal between right and left input signals. The difference signal is phase inverted to obtain an inverted difference signal. Each of two mixing circuits receives the right input signal, the left input signal, the left and right difference signal and the inverted difference signal to produce a left and right output.

U.S. Pat. No. 4,218,585 to Carver is for a dimensional sound producing apparatus and method for stereo systems. The right signal in addition to driving the right speaker, is inverted and delayed and transmitted to the left speaker. The left signal in addition to driving the left speaker is inverted and delayed and transmitted to the right speaker.

U.S. Pat. No. 3,725,586 to Iida is for a multi-sound reproducing apparatus for deriving four sound signals from two sound sources. Left and right sound signals applied to two input circuits are each shifted in phase by phase shifters and then supplied to separate output circuits. The left sound signal is also fed through a low pass filter to be combined with the phase shifted right sound signal and the combined signal supplied to a separate output circuit. Likewise the right sound signal is fed through a low pass filter to be combined with a the phase shifted left sound signal and this combined signal supplied to a separate output circuit.

The method and apparatus of the present invention reproduce a substantially complete audio signal that utilizes a substantial amount of the sound information contained in an audio signals code with improved fidelity and integrity to the original sound source.

In addition to providing a substantially complete audio signal at any link of the audio chain from capture, transmission or storage, to the reproduction of the signal, the present invention also provides a way to reconstruct a substantially complete audio signal from the code contained within an existing, (incomplete) audio signal. The principles of the present invention may be applied to any known signal type, whether single, mono, or discrete, or multiple signals, such as stereo signals in known audio signal applications, from live transmitted sound, such as by telephone, radio broadcast, live sound reinforcement, or by the reproduced sound from a recording, such as from a CD or MP3 player, phonograph, DVD or Blu-Ray player.

Additionally, the present invention also may provide improved intelligibility for speech and dialog, particularly advantageous in telecommunications, motion pictures, and other applications, such as military, law enforcement, medical, and other emergency sound applications. Also, improved clarity, higher resolution, better dynamics, truer tone, broader, bigger, wider space, more precise dynamics, more natural spectral balance, and greater detail, are some of the natural byproducts of presenting the whole, open, original sound components through a complete audio signal.

SUMMARY OF THE INVENTION

Accordingly, the present invention is directed to a method and apparatus for an audio reproduction system that substantially obviates one or more of the problems due to limitations and disadvantages of the related art. As stated, the present invention applies to audio signals. This includes stereophonic signals as well as monophonic and multichannel signals. In accordance with one aspect of the invention, phase-layering is used to achieve a complete audio signal, as explained in the detailed description below. In accordance with another aspect of the invention, a complete audio signal is achieved by adjusting the gain for each of a pair of signals, such that the ratio approximates what is referred to herein as the golden ratio, where each pair of gain adjusted signals are then mixed to produce a corresponding audio output signal.

The golden ratio is, more specifically, a mathematical constant that is defined by two quantities, one larger quantity and one smaller quantity, where the ratio of the sum of the two quantities to the large quantity is equal to the ratio of the larger quantity to the smaller quantity. Numerically, the golden ratio equals one plus the square root of five divided by two which gives an irrational number that equals, approximately, 1.618. While the golden ratio has been used by artists and mathematicians in choosing proportions, and while the ratio is found in nature, it has never been applied to the mixing of audio signals in order to reveal otherwise hidden content buried in those signals.

The objectives and advantages of the present invention may be achieved through an audio signal reproduction method and a circuit implementing the audio signal reproduction method, where the method and circuit involve, among other things, mixing a plurality of input signals in order to generate a plurality of intermediate signals. Each of the intermediate signals are paired with another one of the intermediate signals. The gain of each intermediate signal is adjusted such that the ratio of gains associated with the intermediate signals that make up each pair of intermediate signals at least approximates the golden ratio. The gain adjusted intermediate signals that make up each pair of intermediate signals are then mixed to produce a corresponding output signal.

The objectives and advantages of the present invention may be achieved through an audio signal reproduction method. The method involves, among other things, selecting a discrete signal source having left and right signals, applying the left selected discrete signal to first and second summing circuits, and applying the right selected discrete signal to the second and third summing circuit. The method also involves inverting the left selected discrete signal and applying the inverted left selected discrete signal to a third summing circuit. Similarly, the method involves inverting the right selected discrete signal and applying the inverted right selected discrete signal to the first summing circuit. The output of said first and second summing circuits are applied to a left output summing circuit, and the gain of each input of said left output summing circuit is adjusted such that the ratio of gains at least approximates the golden ratio. The input signals to the left output summing circuit are then mixed to produce a left output signal. The output of the third and second summing circuits are applied to a right output summing circuit, and the gain of each input of said right output summing circuit are adjusted such that the ratio of gains at least approximates the golden ratio. The input signals to the right output summing circuit are then mixed to produce a right output signal.

The objectives and advantages of the present invention may also be achieved through an audio signal reproduction method that involves, among other things, selecting a discrete signal source having left and right signal inputs, summing the left input signal and an inverted right input signal to produce a left−right difference signal, summing the right input signal and an inverted left input signal to produce a right−left difference signal, and summing the left and right input signals to produce a left+right summed signal. The method and circuit further involve adjusting the gain of the left+right summed signal, adjusting the gain of the left−right difference signal, and adjusting the gain of the right−left difference signal. Still further, the method and circuit involve summing the gain adjusted left+right summed signal and the gain adjusted left−right difference signal to produce a left audio output signal, where the ratio of gains associated with the left+right summed signal and the left−right difference signal at least approximates the golden ratio. Similarly, the gain adjusted left+right summed signal and the gain adjusted right−left difference signal are summed to produce a right audio output signal, wherein the ratio of gains associated with the left+right summed signal and the right−left difference signal at least approximates the golden ratio.

The objectives and advantages of the present invention may also be achieved through an audio signal reproduction system. The system comprises, among other things, a discrete signal source having left and right signal outputs. The system also comprises first, second and third summing circuits, each having an output, and each having a left input and a right input operatively connected to the left and right signal outputs of the discrete signal source, respectively, where the left input of the first, second and third summing circuits receive a left input signal associated with the left signal output of the discrete signal source, and the right input of the first, second and third summing circuits receive a right input signal associated with the right signal output of the discrete signal source. The system further comprises a left inverter that inverts the left input signal prior to the third summing circuit, and a right inverter that inverts the right input signal prior to the first summing circuit. Still further, the system comprises a left output summing circuit having first and second inputs connected to the first and second summing circuit outputs, respectively, and having an amplification component for separately adjusting the signal gain at the first and second input, the left output circuit configured to produce a left output signal which is the result of mixing the gain adjusted signals at the first and second input of the left output summing circuit, where the ratio of gains associated with the signals at the first and second input of the left output summing circuit at least approximates the golden ratio. Similarly, the system comprises a right output summing circuit having first and second inputs connected to the second and third summing circuit outputs, respectively, and having an amplification component for separately adjusting the signal gain at the first and second input, the right output circuit configured to produce a right output signal which is the result of mixing the gain adjusted signals at the first and second input of the right output summing circuit, where the ratio of gains associated with the signals at the first and second input of the right output summing circuit at least approximates the golden ratio.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF EXEMPLARY EMBODIMENTS

Reference will now be made in detail to the exemplary embodiments of the present invention, which are illustrated in the accompanying drawings.

Two exemplary embodiments for achieving a substantially complete audio signal according to principles of the present invention are illustrated and disclosed herein. One exemplary embodiment shows a passive signal, while the second embodiment shows an active signal. As one of skill in the art will appreciate, parameters are not fixed to any specific frequency setting, or filter type. Nor are filters limited to angle, or degree, such as 6 dB, 12 dB, 18 dB, or 24 dB. Furthermore, frequency setting, such as 100 Hz for low pass or 16 kHz for high pass are only used as examples for purposes of description.

Figure 1:
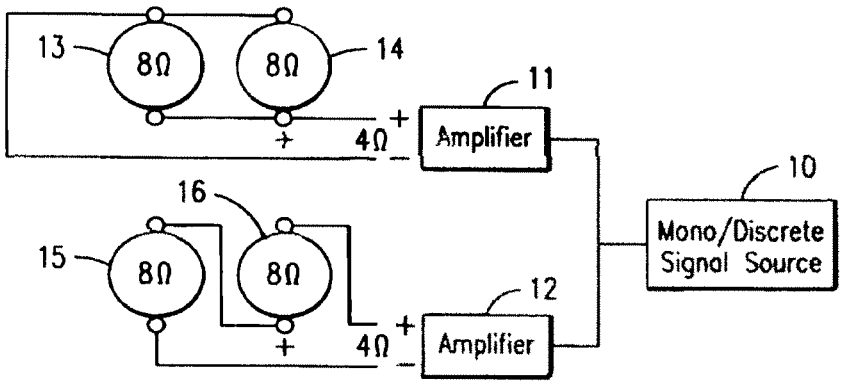
FIG. 1 is a block diagram of a passive sound system in accordance with a first exemplary embodiment of the present invention.

FIG. 1 of the drawings illustrates a block diagram of a passive configuration that can operate with loudspeakers connected to an audio amplifier without an otherwise active circuit. A monophonic or discrete signal source 10 applies a discrete source signal to a first audio amplifier 11 and to a second audio amplifier 12. Amplifier 11 has its output connected to a pair of speakers 13 and 14, each having a voice coil therein to form a first circuit leg. Amplifier 12 has its output connected to a pair of speakers 15 and 16, each having a voice coil therein to form a second circuit leg. Each leg of the circuit can also be configured as one loudspeaker having two voice coils. The speakers can have any impedance load desired but for this example each speaker is 8 ohms and each circuit leg is 4 ohms. It should also be noted that one single amplifier can be used in combination with a specially designed single loudspeaker having 4 voice coils.

The first circuit leg is a parallel circuit connected in-phase, meaning that the amplifier 11 positive connection is connected to the positive connections of both speakers 13 and 14 and the negative connection of the amplifier 11 is connected to the negative connection of both speakers 13 and 14. The second circuit leg is a parallel circuit that is connected out-of-phase with the negative of speaker 15 being connected to the positive of speaker 16 and the positive of speaker 15 connected to the negative terminal of amplifier 12. The negative of speaker 16 is connected to the positive terminal of amplifier 12. The circuit can also be configured by combining the first and second circuit legs in other ways, such as using a single amplifier connected to a quadruple voice coil loudspeaker or transducer. The configuration illustrated in FIG. 1 has the ability to control gains of each circuit leg, and match the impedances of each circuit leg in a simple manner. Each leg of FIG. 1 independently provides the listener with the sound character of the first circuit leg that is consistent with the character of the way audio signals are designed to sound according to industry compliance, or in-phase. The first and second legs individually of FIG. 1 provide partial reproduction of the audio signal such that if the listener listens to the second circuit leg alone, and without hearing the first circuit leg at the same time, the listener thinks the sound is distant, having greater spatial height, width, and depth, yet seeming far away. Combining the two circuit legs simultaneously reproduces a substantially complete audio signal. The sound of the original acoustic event, recording, or reproduced transmission of voice, music, or other audio, is heard substantially as in the original event. The first and second circuit legs should be matched substantially in equal amplitude in order for the substantially complete signal to be formed. If either differs significantly in amplitude, the one with the hotter signal strength will override the other, and the total signal will not be optimally balanced. Therefore, the resulting signal will be less than a substantially complete signal, for example, a signal that has been processed and has the effect of being based on addition, or subtraction of amplitudes and phase, rather than a composite circuit, or substantially complete audio signal. Thus, in this embodiment it is assumed that each speaker is a full range speaker and that the circuit is after the amplifier so that the complete audio signal is being created in the physical air, and, therefore, behaves in a similar and like manner to the original acoustic event. Thus, high pass and low pass crossovers are not necessary in this embodiment.

On the other hand, when using existing audio equipment, usually having multiple loudspeakers, each of which may be a 2 or 3 way (or beyond) speaker system, which usually have additional crossovers that further distort phase information, with each having a limited radiation pattern, high and low paths may better define the physical characteristics of the acoustic information contained within the signal. Thus, with the various high and low passes and phase controls an active circuit may be utilized to generate a substantially whole, or virtually spherical, signal to the amplifier and speakers.

Figure 5:
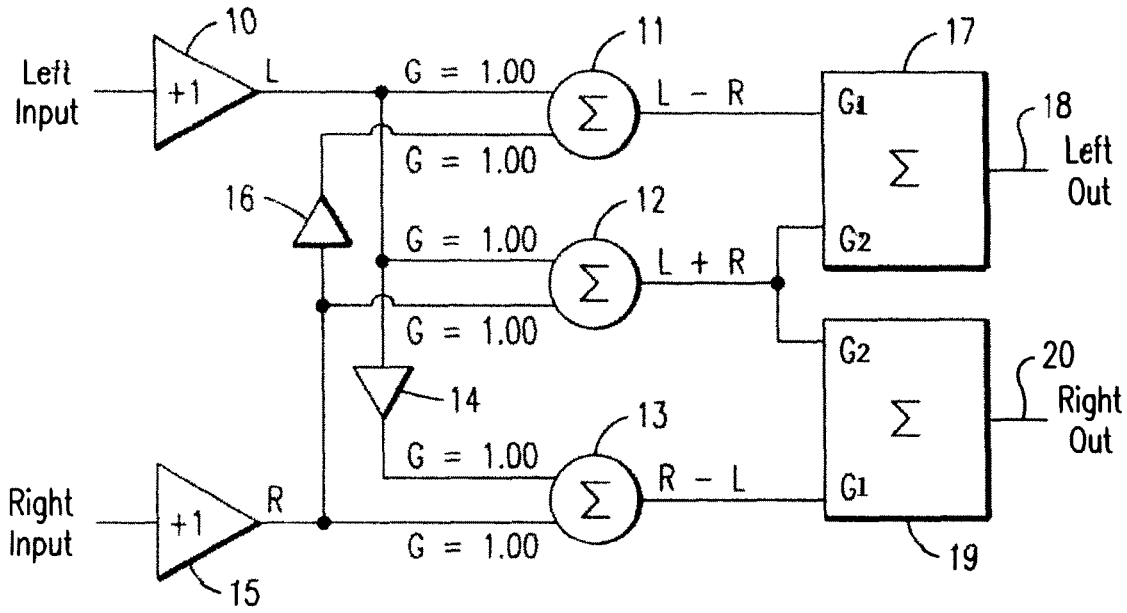
FIG. 5 is a block diagram of an active variation of a sound system in accordance with the first exemplary embodiment of FIG. 1.
Figure 6:
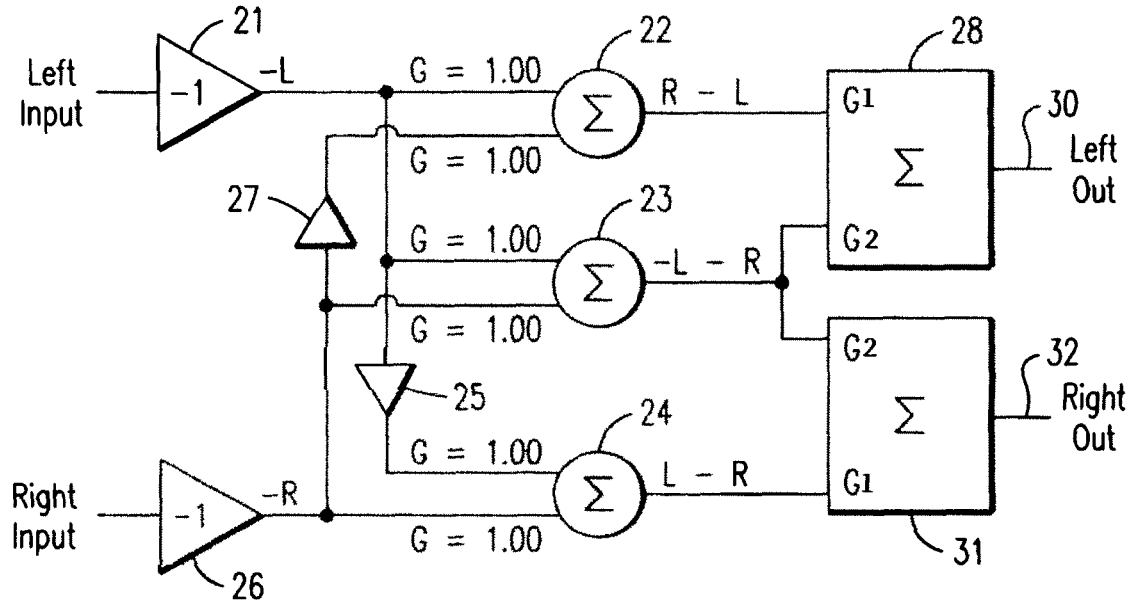
FIG. 6 is a block diagram of a second active variation of a sound system in accordance with the first exemplary embodiment of FIG. 1.

With the passive embodiment of FIG. 1, it is preferable, as stated above, to control the gain so that the amplitude of the in-phase signal of the first leg and the amplitude of the out-of-phase signal of the second leg are substantially equal. However, it is possible to achieve a substantially complete audio signal by employing an active circuit that controls gain so that the amplitudes of these signals are asymmetric. More specifically, the amplitudes of the signals are adjusted so that the ratio of one to the other approaches the golden ratio, which is defined above. FIGS. 5 and 6 are block diagrams of two active circuits that may be employed to achieve this purpose; however, one skilled in the art will appreciate that the circuits in FIGS. 5 and 6 are exemplary, thus the specific circuit components, the arrangement of the circuit components, the order of the circuit components, the number of circuit components and the parameters may vary.

FIG. 5 is, more specifically, a block diagram of an active variation of a sound system in accordance with the first exemplary embodiment of FIG. 1. It will be understood that the audio input to the exemplary circuit of FIG. 5 may be an audio signal from a stereo or dual monophonic amplifier or receiver. However, it will be further understood that any monophonic or discrete source may be used as an input, while the output will normally be an audio speaker or speakers.

As shown in FIG. 5, the left channel signal enters the unity gain (no gain) op-amp 10. The left channel signal is subsequently passed to active audio mixers or summing circuits 11, 12 and 13. In this exemplary embodiment, the left channel signal is inverted by op-amp 14 before entering the audio mixer or summing circuit 13. The right channel signal enters the unity gain op-amp 15. Like the left channel signal, the right channel signal is subsequently passed to the active audio mixers or summing circuits 11, 12, and 13. In this exemplary embodiment, the right channel signal is inverted with op-amp 16 before entering the audio mixer or summing circuit 11.

Each of the audio mixers or summing circuits 11, 12 and 13 output a corresponding intermediate signal. More particularly, the output of audio mixer or summing circuit 11 is a discrete L−R signal. The output of audio mixer or summing circuit 12 is a discrete L+R signal. The output of audio mixer or summing circuit 13 is a discrete R−L signal. The discrete L−R signal (i.e. the output of audio mixer or summing circuit 11) and the discrete L+R signal (i.e., the output of audio mixer or summing circuit 12) are then passed to audio mixer or summing circuit 17. The discrete L+R signal (i.e., the output of audio mixer or summing circuit 12) and the discrete L−R signal (i.e., the output of audio mixer or summing circuit 13) are passed to audio mixer or summing circuit 19.

A complete audio signal is, in this alternative exemplary embodiment, achieved by asymmetrically adjusting the gain of the discrete audio signals R−L, L+R and L−R such that the amplitude of each of these signals compared to the amplitude of the discrete audio signal with which it is paired in summing circuit 17 or 19 approximates the golden ratio. Prior to mixing in audio mixer or summing circuit 17, the gain associated with the discrete L−R signal is adjusted to a value G1, while the gain associated with the discrete L+R signal is adjusted to a value G2, where the value of G1 and G2 are set such that the ratio of gains is equal to the golden ratio. Similarly, prior to mixing in audio mixer or summing circuit 19, the gain associated with the discrete R−L signal is adjusted to G1, while the gain associated with the discrete L+R signal is adjusted to approximately G2. As stated, the value of G1 and G2 are set such that the ratio of gains is equal to the golden ratio. Audio mixer or summing circuit 17 then generates a left output signal 18, which is passed to an audio transducer or speaker (not shown), and audio mixer or summing circuit 19 generates an output signal 20, which is passed to an audio transducer or speaker (not shown). One of ordinary skill in the art will appreciate that the gain of each of the discrete audio signals R−L, L+R and L−R may be adjusted by employing amplification components, such as op-amps (not shown), that may be incorporated in or separate components from the audio mixers or summing circuits 17 and 19.

FIG. 6 is, more specifically, a block diagram of a second active variation of a sound system in accordance with the first exemplary embodiment of FIG. 1. Again, it will be understood that the audio input to the exemplary circuit of FIG. 6 may be an audio signal from a stereo or dual monophonic amplifier or receiver; however, any monophonic or discrete source may be used as an input, while the output will normally be an audio speaker or speakers.

As shown in FIG. 6, the left channel signal enters the inverting unity gain op-amp 21. The left channel signal is subsequently passed to active audio mixers or summing circuits 22, 23 and 24. In this exemplary embodiment, the left channel signal is inverted by op-amp 25 before entering the audio mixer or summing circuit 24. The right channel signal enters the inverting unity gain op-amp 26. Like the left channel signal, the right channel signal is subsequently passed to the active audio mixers or summing circuits 22, 23, and 24. In this exemplary embodiment, the right channel signal is inverted with op-amp 27 before entering the audio mixer or summing circuit 22.

Each of the audio mixers or summing circuits 22, 23 and 24 output a corresponding intermediate signal. More particularly, the output of audio mixer or summing circuit 22 is a discrete R−L signal. The output of audio mixer or summing circuit 23 is a discrete −L−R signal. The output of audio mixer or summing circuit 24 is a discrete L−R signal. The discrete R−L signal (i.e. the output of audio mixer or summing circuit 22) and the discrete −L−R signal (i.e., the output of audio mixer or summing circuit 22) are then passed to audio mixer or summing circuit 28. The discrete −L−R signal (i.e., the output of audio mixer or summing circuit 23) and the discrete R−L signal (i.e., the output of audio mixer or summing circuit 24) are passed to audio mixer or summing circuit 31.

A complete audio signal is, in this second alternative exemplary embodiment, achieved by asymmetrically adjusting the gain of the discrete audio signals L−R, −L−R and R−L such that the amplitude of each of these signals compared to the amplitude of the discrete audio signal with which it is paired in summing circuit 28 or 31 approximates the golden ratio. Prior to mixing in audio mixer or summing circuit 28, the gain associated with the discrete R−L signal is adjusted to G1, while the gain associated with the discrete −L−R signal is adjusted to G2, where the value of G1 and G2 are set such that the ration of gains is equal to the golden ratio. Similarly, prior to mixing in audio mixer or summing circuit 31, the gain associated with the discrete L−R signal is adjusted to G1, while the gain associated with the discrete −L−R signal is adjusted to G2. Again, the value of G1 and G2 are set such that the ratio of gains is equal to the golden ratio. Audio mixer or summing circuit 28 then generates a left output signal 30, which is passed to an audio transducer or speaker (not shown), and audio mixer or summing circuit 31 generates an output signal 32, which is passed to an audio transducer or speaker (not shown). One of ordinary skill in the art will appreciate that the gain of each of the discrete audio signals L−R, −L−R and R−L may be adjusted by employing amplification components, such as op-amps (not shown), that may be incorporated in or separate components from the audio mixers or summing circuits 28 and 30.

It is again noted that each of summing circuits 17 and 19, in FIG. 5, and each of summing circuits 28 and 31, in FIG. 6, mixes a pair of discrete audio signals, where the gains applied to the discrete audio signals that make up each corresponding pair have been asymmetrically adjusted so that the ratio of gains G1:G2 is equal to the golden ratio. Thus, for example, G1 might be set to a value of 1.618 and G2 might be set to a value of 1.0. This would result in a ratio of 1.618. For the purpose of the present application, it is preferable that the ratio of gains associated with the discrete audio signals that make up each pair is within 10 percent of the golden ratio (i.e., approximated at 1.618); however, depending on the application, this percentage may vary.

Figure 2:
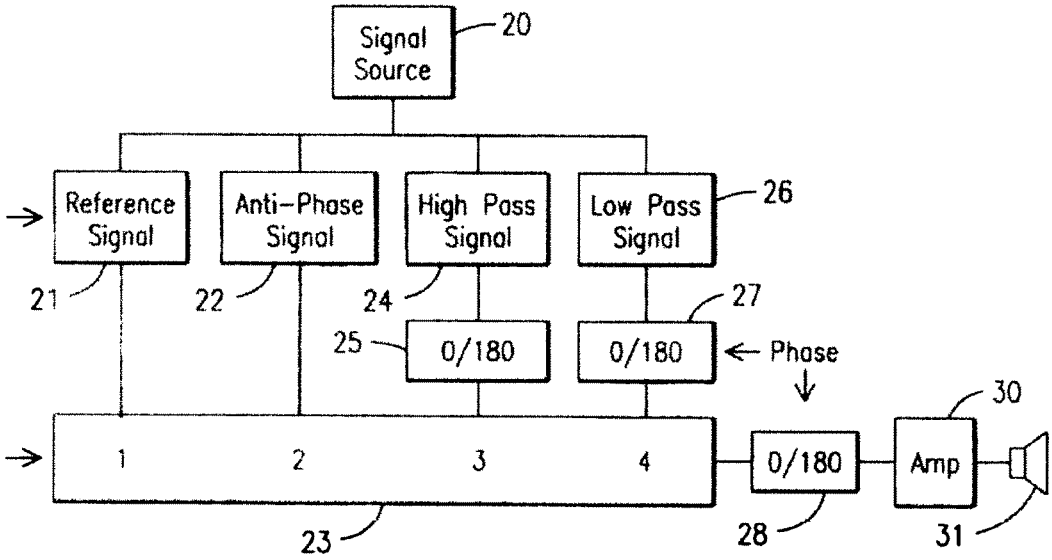
FIG. 2 is a block diagram of an active sound system in accordance with a second exemplary embodiment of the present invention.

FIG. 2 shows a basic block diagram for an active circuit for generating a substantially complete audio signal including high pass and low pass crossovers. By active, it is meant a circuit that requires power to operate and is connected in line before the signal reaches the amplifier. The active circuit may be connected to the signal source itself, or anywhere before or inside the amplifier.

In FIG. 2, a signal source 20 may be a radio, CD player, mp3 player, or the like for listening to music, or a live voice or live reproduction signal, such as one would speak into a cell phone, or telephone, or a microphone or a broadcast device, or the like. The signal from the signal source 20 is split into duplicates of itself using a splitter or other means, or through repeated duplication in a mixer, with splitter capabilities.

The original or reference signal 21 is assumed to be in-phase as it comes from the signal source 20. Being in-phase is a relative term, defining the original signal as the reference signal. This reference signal is also incomplete in that it does not provide a method for extracting concealed or hidden information, which remains folded within the original by reason of the fact that it is canceled by being out of phase, or out of polarity, with the in-phase, or in step, reference signal. One duplicate of the reference signal is used to generate a phase layered signal 22.

Phase layering uses a combination of inverted phase (180°) together with smaller sectional phase shifts, (e.g. 45°, 90°) and so on, to establish a substantially whole signal that would otherwise be canceled using traditional in-phase and out-of-phase approaches. The result is a substantially complete audio signal that is whole, open, omni-directional, and multi-dimensional, having similar and like properties to the original sound event. Essentially, applying any number or mixture of these myriad techniques will produce a usable phase-layered signal. In essence, phase layering is a way of providing a substantially complete signal without canceling the in-phase signal. The use of a phase layered signal is to provide a continuity of phase relative information, or otherwise concealed information, as a modular component that layers in equally with the reference signal.

The reference signal 21 and the phase layered signal 22 are sent into a signal mixer 23. A third or high pass signal 24 represents any point of frequency above 1 kcps, more or less. A polarity switch 25 switches polarity or phase from 0°~180° prior to sending the signal to the mixer 23. A fourth or low pass signal 26 may have a frequency below 1 kcps, more or less, and also has a 0°~180° phase shift control 27 prior to sending to the mixer 23. The purpose of the high and low pass signals is to apply spherical angles of degrees, or phase layers, to what might otherwise be flattened out by a typical amp-speaker using multiple crossovers. By applying these angles, of 45°, more or less, layers of phase form into a final, substantially complete audio signal composite that provides a virtually spherical acoustic signal. The resulting reproduced signal can be appreciated as being an improved sound when played through any and all existing audio systems. Global phase control may be provided because this new substantially complete audio signal includes a composite reference that will reveal whether any external signal input is, in fact, actually in phase, or out of phase. Standard audio systems do not have a reference for determining phase differences. The present invention enables detection of phase differences and allows for a measuring tool for relative phase identification.

The mixed signal from the mixer 23 is applied through a phase reversal switch 28 and to an amplifier 30 to drive a loudspeaker 31. A circuit in accordance with the principles of the present invention may be incorporated into hardware or can be embodied in a stand-alone integrated circuit and may be reformulated mathematically, enabling construction of software to produce a substantially complete signal. This active open signal can be placed between the output of a signal source, such as a CD player at one extreme, or at a teleport transmitting station to satellite at an opposite extreme. It can be applied to work as a circuit in a cellular phone or elsewhere. This present method can be employed actively, at the A-Chain, meaning, at the front end of the signal process, such as in applications between the output of a signal source and the input of the amplifier, splitter, or the like.

Figure 3:
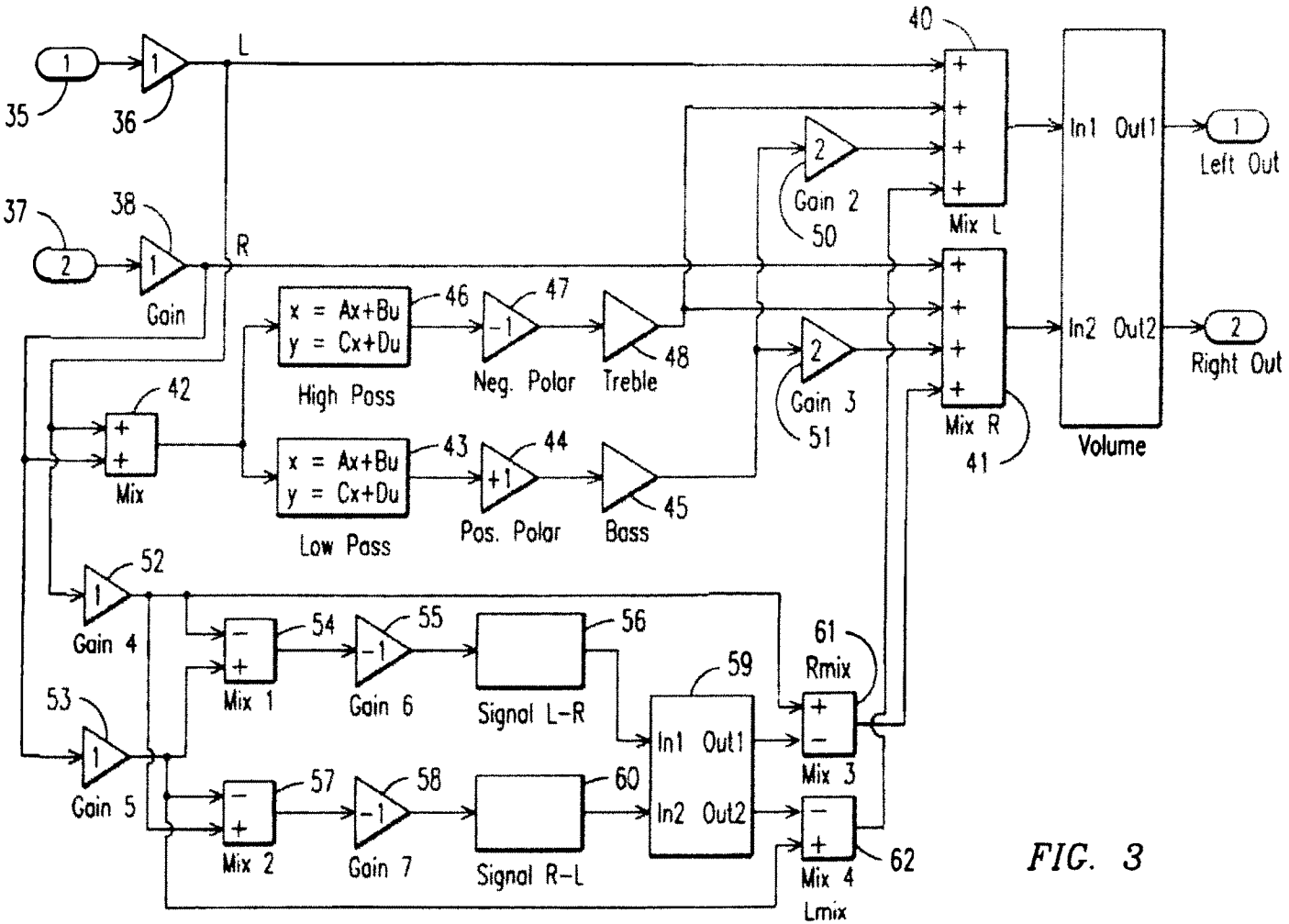
FIG. 3 is a schematic of the block diagram in FIG. 2.
Figures 4, 4A, 4B:
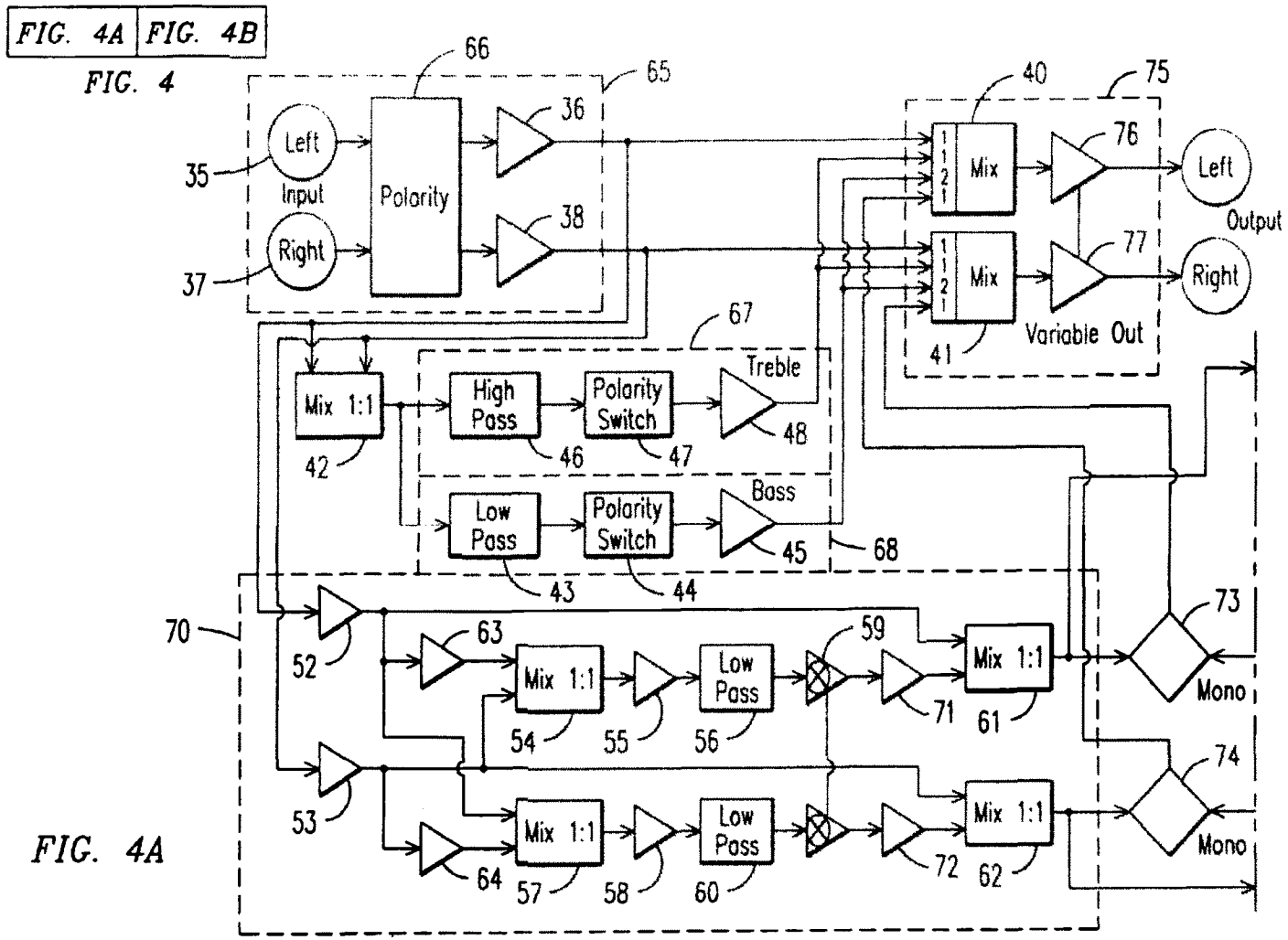
FIGS. 4A and 4B are expanded schematics for the schematic in FIG. 3.
Figure 4B:
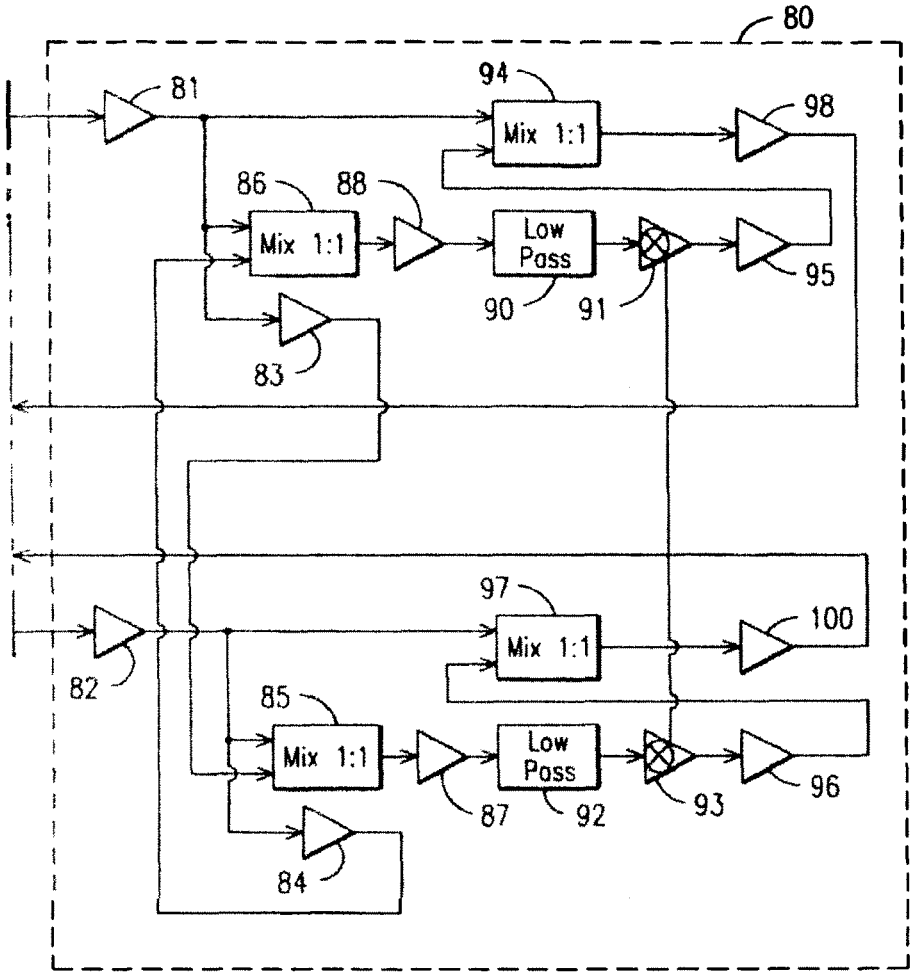

FIG. 3 is a block schematic of the active circuit of FIG. 2 for stereo signals for unfolding, recovering, and revealing, hidden and buried spatial, spectral, dynamic, and other acoustic information contained in audio signals. FIGS. 4A and 4B together illustrate a more detailed block schematic of the circuit of FIG. 3, adding a monophonic hemisphere circuit.

Referring to FIG. 3, the input stage receives at least one audio signal having a positive and negative polarity. Shown here as an example is a stereo signal, wherein the left stereo signal input 35 is connected to an amplifier 36 while the right stereo input 37 is connected to an amplifier 38. The output of the left signal amplifier 36 is applied to a left mixer 40, while the output of the right amplifier 38 is connected to a right mixer 41. The left and right outputs from the amplifiers 36 and 38 are applied to a mixer 42 where the signals are summed and the summed signal applied to bass and treble circuits. The summed signals are sent through the bass circuit having a low pass filter 43 (such as 100 Hz) where the polarity is reversed in an amplifier 44 and applied to an adjustable gain amplifier 45 that can be used for tuning.

The summed signal from the mixer 42 is also applied to the treble circuit path, which is parallel to the bass circuit path, and in which the summed signal is applied to a high pass filter 46 (such as 1000 Hz) and has a polarity adjusting amplifier 47 and an adjustable gain amplifier 48 available for tuning. The output phase of the treble path can have different settings but as shown leads the reference phase by 90 degrees to provide one phase layer which is applied to both the left mixer 40 and the right mixer 41. The output phase of the bass circuit can have different settings but as shown lags the reference phase by 90 degrees to provide another phase layer. The output of the bass circuit is connected to the left mixer 40 and to the right mixer 41 through a pair of gain amplifiers 50 and 51. A stereo hemisphere circuit applies the left input 35 signal through a buffering amplifier 52 and the right input 37 signal through a buffering amplifier 53. The left stereo signal is subtracted from the right stereo signal (Signal L−R) in a separate path in mixer 54 and is put through an inverting amplifier 55 and is low-pass filtered (−16 kHz) in the filter circuit 56 and fed to linked voltage controlled amplifiers 59 and to mixer 61. The output from the amplifier 52 is also coupled to the mixer 61.

The right input 37 signal from buffering amplifier 53 is subtracted from the left stereo signal (Signal R−L) in mixer 57 and through an inverting amplifier 58 in a parallel path to the left signal and is low-pass filtered (−16 kHz) in filter circuit 60 and is connected to the linked voltage controlled amplifier 59 and to mixer 63. The buffering amplifier 53 is also coupled directly to the mixer 63.

The gain of these two, filtered, difference signals (Signal L−R and Signal R−L) can be adjusted in parallel, and Signal L−R subtracted from the left stereo signal in the mixer 61 (defined as Signal Rmix) and Signal R−L, in a parallel path, subtracted from the right stereo signal in mixer 62 (defined as Signal Lmix). The output of the Rmix mixer 61 is applied to the right mixer 41 and the output of the Lmix mixer 62 is applied to the mixer 40. The left stereo signal is summed in mixer 40 with the treble circuit signal, the bass circuit signal, and Lmix output to produce the phase layered left channel output signal. The right stereo signal is summed in mixer 41 with the treble circuit signal, the bass circuit signal, and the Rmix output to produce the phase layered right channel output signal.

Turning to FIG. 4 of the drawings, a more detailed schematic block diagram has combined active stereo and monophonic circuits in accordance with principles of the present invention.

The input circuit 65 has left and right inputs 35 and 37 connected to a polarity switch 66 that is connected to gain amplifiers 35 and 38 and is set up to provide polarity switching of the input signal based on the position of the switch 66. The switch 66 is linked so it reverses polarity of both channels practically simultaneously, to set the 'Absolute Phase' of the audio signal.

The outputs from the input circuit are applied to both a treble circuit 67 and a bass circuit 68. Left and right signals are summed in the mixer 42. In the treble circuit 67, the summed signal from the mixer 42 is filtered through a two pole filter 46 with the −3 dB point at 1000 Hz. A polarity switch 47 inverts the signal if necessary. There is a control amplifier for mixing in bass from +0 dB to +6 dB. In the bass circuit 68, the summed signals from the mixer 42 are filtered through a two pole filter with the −3 dB point at 100 Hz. There is a polarity switch 44 to invert the signal if necessary and a level control 45 for mixing in bass from +0 dB to +6 dB.

A stereo hemisphere circuit 70 uses the right and left signals from the input circuit 65 through buffering amplifiers 52 and 53.

The hemisphere circuit 70 has parallel legs, with the input signal from buffering amplifier 52 being inverted in amplifier 63 and summed with the signal from amplifier 63 in a mixer 56 to get a L−R signal. The signal from buffering amplifier 53 is inverted in amplifier 64 and summed with the signal from amplifier 52 in mixer 57 to get a R−L signal. The inverted signal from amplifier 55 is filtered with a low pass filter 56 and is adjustable with linked Voltage Controlled Amplifiers (VCAs) 59. The inverted signal from amplifier 58 is filtered with a low pass filter 60 and is adjustable with linked VCA 59. The outputs of the VCAs 59 are inverted with amplifiers 71 and 72 and the signal from amplifier 71 summed with the signal from amplifier 52 in mixer 61. The output from amplifier 72 is summed with the output from buffering amplifier 53 in mixer 62. The signal from mixer 61 is fed into switch 73 and the signal from mixer 62 is fed to switch 74. The stereo signal from mixer 61 is sent to the output circuit 75 mixer 40 and to the monophonic hemisphere circuit 80. The output from mixer 62 is sent to the output circuit 75 mixer 41 and to the monophonic hemisphere circuit 80. Output of mixer 40 is connected to a variable output 76 and output of mixer 41 is connected to a variable output 77.

The left stereo signal input from amplifier 36 is summed with the treble and bass circuit output signals and with the mixed signal from amplifier 61 in mixer 41 to produce the phase layered left channel output signal.

The right stereo signal input from amplifier 38 is summed with treble and bass circuit output signals and with the mixed signal from amplifier 62 to produce the phase layered right channel output signal.

If the switches 73 and 74 are placed in monophonic mode, the output of the hemisphere stereo mixer 73 is inverted in the inverting amplifier 81 and the output of the hemisphere mixer 62 is inverted in inverting amplifier 82. The signal from inverter 81 is inverted again in inverting amplifier 83 and the inverted signal of inverter 82 is inverted again in inverter 84. The inverted signal from amplifier 83 is fed to the mixer 85 and mixed with the signal from inverter 82 and the output from inverting amplifier 84 is fed to mixer 86 and mixed with the inverted signal from inverter 81. The mixed signal from mixer 86 is inverted in amplifier 88 and the output of mixer 85 is inverted in amplifier 87. The inverted signal from amplifier 88 is passed through a low pass filter 90 and sent to the linked voltage controlled amplifier 91. The inverted signal from amplifier 87 is passed through a low pass filter 92 and sent to the linked voltage controlled amplifier 93. The VCA 91 output is inverted in amplifier 95 and fed into a mixer 94 and mixed with the signal from inverter 81. The signal is then inverted in amplifier 98 and applied to the switch 73 and hence to the mixers 40 and 41. The output of VCA 93 is inverted in amplifier 96 and fed into a mixer 97 and mixed with the signal from inverter 82. The signal is then inverted in amplifier 100 and applied to the switch 74 and hence to the mixers 40 and 41.

The output circuit 75 mixes the signals in the ratios for left and right inputs as follows: Left and right input=1; Treble circuit output=1; Bass circuit output=2; and the stereo or mono hemisphere output=1.

Referring to FIG. 4A, the process of the present invention includes selecting a discrete signal source (35 and 36) and producing an in-phase reference signal from the input circuit 65. An inverted phase signal is produced from the reference signal in the stereo hemisphere circuit 70 to produce an out-of-phase signal with the reference signal. A phase layered signal is produced from the reference signal in the treble circuit 67 which may have a phase leading the reference signal by 90 degrees. A phase layered signal is also produced from the reference signal in the bass circuit 68 which may have a phase lagging the reference signal phase by 90 degrees. The phase layered signals can lead or lag the reference signal by 90 degrees or by 45 degrees or can be set to any phase leading or lagging the reference signal. between 0-180 degrees.

It should be clear at this time that an audio reproduction system has been produced which provides a virtually omni-directional and open sound from an audio signal source, enabling an otherwise standard, incomplete audio signal, to be transformed into a substantially complete audio signal. However the present invention is not to be construed as limited to the forms shown which are to be considered illustrative rather than restrictive.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents. For example, one skilled in the art will appreciate that the present invention may be implemented using analog or digital techniques, and through the use of hardware, software or a combination thereof.

I claim:

1. An audio reproduction system comprising:

a discrete signal source;

a reference signal circuit coupled to said discrete signal source for producing an in-phase reference signal;

a phase inverting signal circuit coupled to said discrete signal source for producing a polarity-inverted signal from said discrete signal source;

a first phase layered signal circuit coupled to said discrete signal source for producing a first phase layered signal by an instantaneous or substantially instantaneous change in phase of said discrete signal source;

a second phase layered signal circuit coupled to said discrete signal source for producing a second phase layered signal by an instantaneous or substantially instantaneous change in phase of said discrete signal source;

amplifier circuitry for adjusting the amplitude of the first phase layered signal and the second phase layered signal; and an output circuit coupled to the output of said reference signal circuit and the output of said phase inverting signal circuit and the output of said amplifier circuitry to form a composite output signal based on said in-phase reference signal, said polarity-inverted signal and said amplitude adjusted first and second phase layered signals.

2. The audio reproduction system of claim 1, wherein the amplifier circuitry is configured to asymmetrically adjust the amplitude of the first phase layered signal and the amplitude of the second phase layered signal relative to each other.

3. The audio reproduction system of claim 2, wherein the amplifier circuitry asymmetrically adjusts the amplitude of the first phase layered signal and the amplitude of the second phase layered signal in accordance based on a ratio of 1.618±10 percent.

4. The audio reproduction system of claim 3, wherein the amplifier circuitry is configured to separately adjust the amplitude of the first phase layered signal and the amplitude of the second phase layered signal.

5. The audio reproduction system of claim 1, wherein the in-phase reference signal and the polarity-inverted signal are applied to a corresponding unity gain amplifier.

6. An audio reproduction system comprising:

a discrete signal source;

a reference signal circuit coupled to said discrete signal source for producing an in-phase reference signal;

a phase inverting signal circuit coupled to said discrete signal source for producing a polarity-inverted signal from said discrete signal source;

amplifier circuitry coupled to said discrete signal source for producing a first amplitude adjusted discrete signal and a second amplitude adjusted discrete signal;

a first phase layered signal circuit coupled to said amplifier circuitry for producing a first phase layered signal by an instantaneous or substantially instantaneous change in phase of said amplitude adjusted first discrete signal;

a second phase layered signal circuit coupled to said amplifier circuitry for producing a second phase layered signal by an instantaneous or substantially instantaneous change in phase of said amplitude adjusted second discrete signal; and an output circuit coupled to the output of said reference signal circuit and the output of said phase inverting signal circuit and the output of said first and second phase layered signal circuits to form a composite output signal based on said in-phase reference signal, said polarity-inverted signal and said amplitude adjusted first and second phase layered signals.

7. The audio reproduction system of claim 6, wherein the amplifier circuitry is configured to asymmetrically adjust the amplitude of the in-phase reference signal and the amplitude of the polarity-inverted signal relative to each other.

8. The audio reproduction system of claim 7, wherein the amplifier circuitry asymmetrically adjusts the amplitude of the in-phase reference signal and the amplitude of the polarity-inverted signal.

9. The audio reproduction system of claim 8, wherein the amplifier circuitry is configured to separately adjust the amplitude of the in-phase reference signal and the amplitude of the polarity-inverted signal.

10. The audio reproduction system of claim 6, wherein the in-phase reference signal and the polarity-inverted signal are applied to a corresponding unity gain amplifier.

* * * * *